US009458978B2

(12) United States Patent
Motomura

(10) Patent No.: US 9,458,978 B2
(45) Date of Patent: Oct. 4, 2016

(54) VEHICLE LAMP

(71) Applicant: KOITO MANUFACTURING CO., LTD., Tokyo (JP)

(72) Inventor: Kenichi Motomura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/043,226

(22) Filed: Oct. 1, 2013

(65) Prior Publication Data

US 2014/0092616 A1 Apr. 3, 2014

(30) Foreign Application Priority Data

Oct. 3, 2012 (JP) ..... 2012-221421
Apr. 12, 2013 (JP) ..... 2013-084327

(51) Int. Cl.
*F21S 8/10* (2006.01)

(52) U.S. Cl.
CPC ..... *F21S 48/2212* (2013.01)

(58) Field of Classification Search
CPC ..... F21S 48/2212
See application file for complete search history.

(56) References Cited

U.S. PATENT DOCUMENTS 1,539,090 A * 5/1925 King ..... F21S 48/10 362/308
1,992,670 A * 2/1935 Luce ..... B60Q 1/26 359/543
2,215,203 A * 9/1940 Young ..... F21S 48/1225 362/538
2,276,104 A * 3/1942 Shaunessey ..... B60Q 1/2607 353/13
4,811,174 A 3/1989 Kanzler et al.
5,613,769 A * 3/1997 Parkyn et al. ..... 362/338
5,699,201 A * 12/1997 Lee ..... 359/708
8,070,329 B1 * 12/2011 Bechtel et al. ..... 362/331
2005/0180156 A1 * 8/2005 Iwasaki ..... F21S 48/1159 362/538
2006/0028831 A1 * 2/2006 Ishida ..... 362/509
2008/0037116 A1 * 2/2008 Alasaarela et al. ..... 359/433
2008/0310166 A1 * 12/2008 Chinniah et al. ..... 362/268
2009/0207586 A1 * 8/2009 Arai et al. ..... 362/97.1
2010/0177526 A1 * 7/2010 Futami ..... 362/519
2012/0033441 A1 * 2/2012 Sousek et al. ..... 362/555

FOREIGN PATENT DOCUMENTS

JP 6366801 A 3/1988

* cited by examiner

*Primary Examiner* — Elmito Breval
(74) *Attorney, Agent, or Firm* — Sughrue Mion, PLLC

(57) ABSTRACT

A vehicle lamp is provided which includes a toroidal lens 30 which extends into an arc shape so as to surround a light source 20 from a front side thereof. By adopting this configuration, light emitted from the light source 20 is allowed to emanate from the toroidal lens 30 as it is as diffuse light in a horizontal plane in which the toroidal lens 30 extends, while the light is allowed to emanate from the toroidal lens 30 as parallel light in a vertical plane. Furthermore, a front surface 30Aa of a central portion 30A of the toroidal lens 30 in the direction in which the toroidal lens 30 extends into the arc shape is formed so as to be displaced rearwards relative to an imaginary extensional plane C1 from front surfaces 30Ba of general portions 30B which are situated at both sides of the central portion 30A.

9 Claims, 8 Drawing Sheets

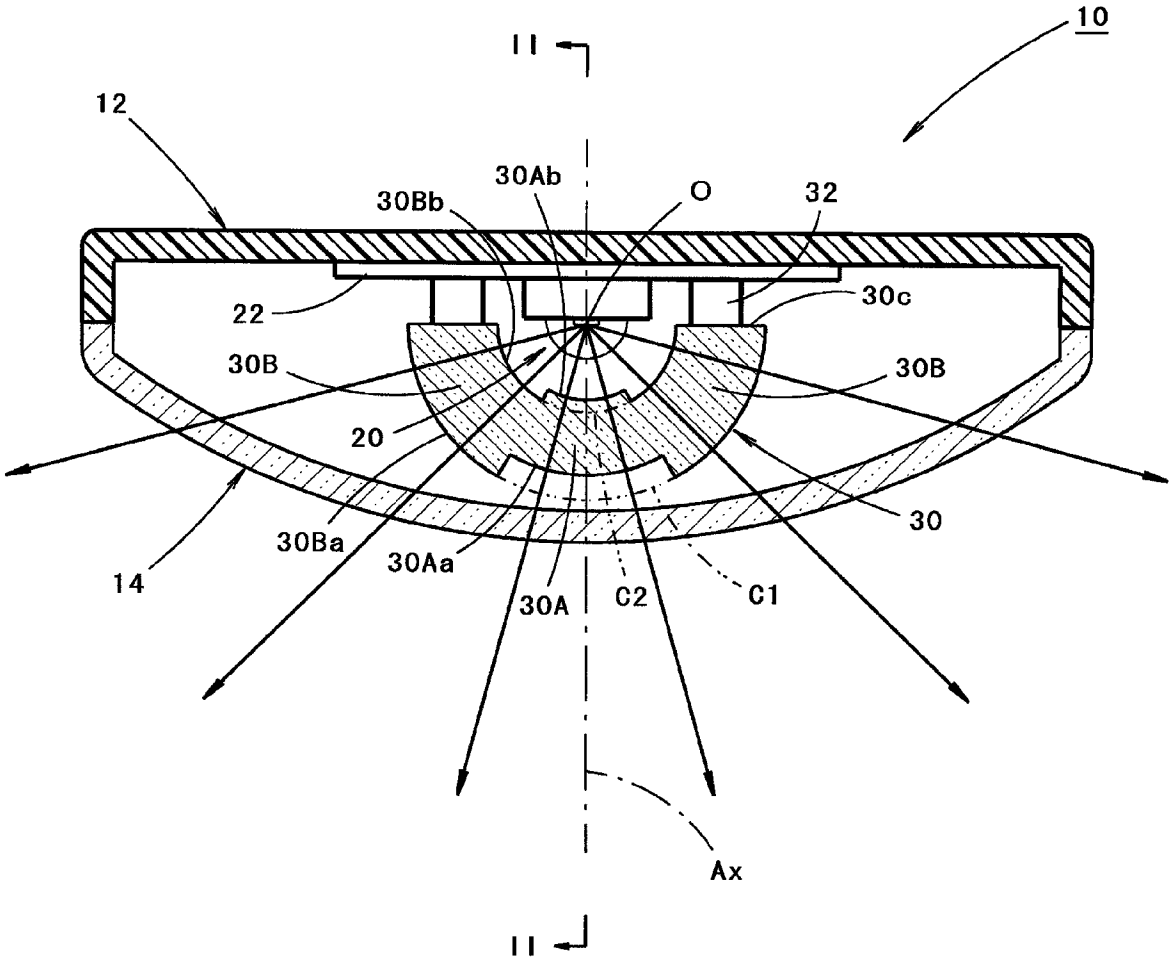
FIG.1
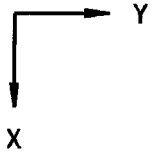

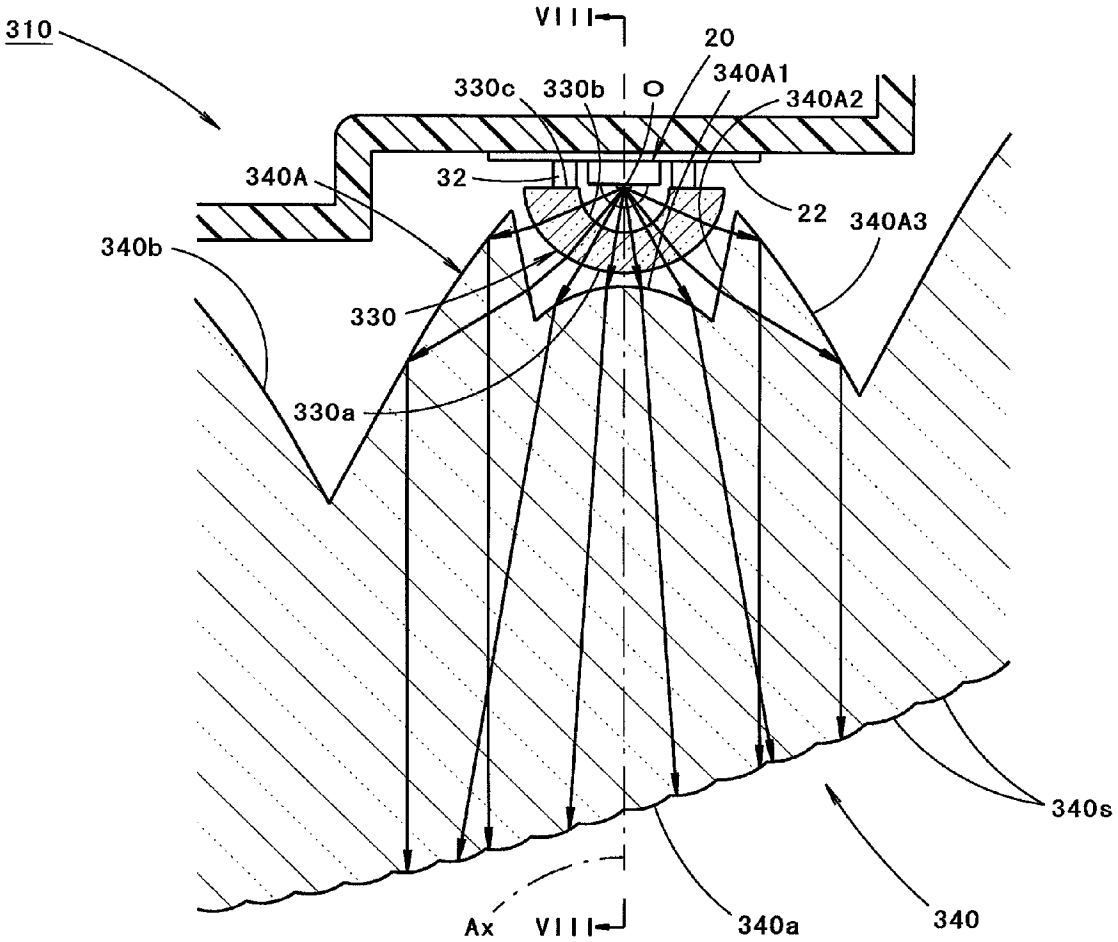
FIG.7
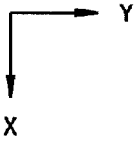

VEHICLE LAMP

CROSS-REFERENCE TO RELATED APPLICATIONS

The present application claims the benefit of priority of Japanese Patent Applications No. 2012-221421, filed on Oct. 3, 2012, and No. 2013-084327, filed on Apr. 12, 2013, which is incorporated herein by reference.

BACKGROUND

1. Field of the Invention

Embodiments of the present invention relates to a vehicle lamp including a toroidal lens.

2. Related Art

A configuration of a vehicle lamp which has a toroidal lens which extends into an arc-like shape so as to surround a light source from a front side thereof, is disclosed in JP-A-S63-66801.

Such the configuration of the vehicle lamp enables light emitted from the light source to emanate from the toroidal lens as it is as diffuse light in a first plane in which the toroidal lens extends. Further, such the configuration of the vehicle lamp enables the light to emanate as parallel light in a second plane which intersects the first plane at right angles.

Therefore, such the configuration of the vehicle lamp enables to form a light distribution pattern which expands into a belt-like shape by light emitted from the toroidal lens easily.

SUMMARY

However, it is difficult to reduce the thickness of the lamp in depth direction because the toroidal lens is disposed so as to extend into the arc-like shape on the front side of the light source in the lamp, and therefore, a depth size of the toroidal lens has to be increased to some extent.

To solve the above-mentioned problem, one or more embodiments of the present invention provides a vehicle lamp including a toroidal lens which can realize a reduction in thickness of the lamp.

The invention is made to attain the object by devising the configuration of a toroidal lens.

One embodiment of the present invention provides a vehicle lamp including a light source, and a toroidal lens which extends into an arc-like shape along a first plane so as to surround the light source from a front side thereof, wherein a front surface of a central portion of the toroidal lens in a direction in which the toroidal lens extends into the arc-like shape is formed so as to be displaced rearwards relative to an imaginary extensional plane from front surfaces of general portions of the toroidal lens which are situated at both sides of the central portion.

There is imposed no specific limitation on the type of the light source, and hence, for example, a light emitting diode can be adopted as the light source.

Although the "toroidal lens" extends into the arc-like shape along the first plane so as to surround the light source from the front side thereof, in this respect, there is imposed no specific limitation on the orientation of the "first plane."

The "imaginary extensional plane from front surfaces of general portions" means an imaginary plane which is formed by extending the front surfaces of the general portions in the direction in which the toroidal lens extends into the arc-like shape.

As shown in the configuration described above, the vehicle lamp according to the invention includes the toroidal lens which extends into the arc-like shape so as to surround the light source from the front side thereof. Therefore, the light emitted from the light source is allowed to emanate from the toroidal lens as it is as diffuse light in the first plane in which the toroidal lens extends, while in the second plane which intersects the first plane at right angles, the light is allowed to emanate from the toroidal lens as parallel light, thereby making it possible to form the light distribution pattern which expands into the belt-like shape.

As this occurs, the toroidal lens is formed so that the front surface of the central portion thereof in the direction in which the toroidal lens extends into the arc-like shape is displaced rearwards relative to the imaginary extensional plane from the front surfaces of the general portions which are situated at the sides of the central portion. Therefore, the depth dimension of the toroidal lens can be reduced while maintaining the optical function of the toroidal lens, this enabling the reduction in thickness of the lamp.

In this way, according to the invention, it is possible to reduce the thickness of a vehicle lamp including a toroidal lens.

In the configuration described above, in the event that a configuration is adopted in which the curvature of a curve which forms a sectional shape of the front surface of the central portion of the toroidal lens along the second plane which intersects the first plane at right angles is set to a larger value than a curvature of a curve which forms a sectional shape of the front surface of the general portion of the toroidal lens along the second plane, the following working effects can be obtained.

Namely, in such a setting that light emitted from the general portions becomes parallel light within the second plane, only by simply displacing the front surface of the central portion rearwards relative to the imaginary extensional plane from the front surfaces of the general portions, light emitted from the central portion becomes light which is slightly diffused in the second plane. In contrast with this, in the event that the configuration is adopted in which the curvature of the curve forming the sectional shape along the second plane is set larger at the front surface of the central portion than at the front surfaces of the general portions, light emitted from the central portion can also be made into parallel light even in the second plane.

Here, the "second plane" means a plane of planes intersecting the first plane which contains an axis which becomes a rotational axis of the toroidal lens which extends into the arc-like shape.

In the configuration described above, in the event that a configuration is adopted in which a sectional shape of a rear face of the central portion along the second plane is formed into a convex curvilinear shape, when compared with a configuration in which the sectional shape is formed into a rectilinear shape, even though the curvature of the front surface of the central portion is reduced, light emitted from the central portion can be made into parallel light in the second plane. In addition, the depth dimension of the toroidal lens can be reduced to such an extent that the curvature of the front surface of the central portion is so reduced.

In the configuration described above, in the event that a configuration is adopted in which a light guiding plate which allows light from the light source emanating from the toroidal lens to enter from a rear surface to emanate from a front surface thereof is disposed so as to extend along the first plane and the rear surface of the light guiding plate is formed of a first incident portion where light emanating from the toroidal lens is allowed to enter in such a way as to be refracted forwards, second incident portions provided individually at sides of the first incident portion and where light emanating from the toroidal lens is allowed to enter in such a way as to be refracted sideways and reflecting portions which reflect light emanating from the toroidal lens and entering from the second incident portions towards the front through internal reflection, a light distribution control on light emitted from the light source can be executed with good accuracy.

As this occurs, the toroidal lens can be disposed closer to the first incident portion of the light guiding plate by such an extent that the depth dimension of the toroidal lens can be reduced. Therefore, the position of the light source can also be displaced to the front accordingly. Then, by dong so, more light emanating from the toroidal lens is allowed to enter the light guiding plate, thereby making it possible to enhance the light utilization efficiency of light emitted from the light source.

Incidentally, in the event that a lens in which a sectional shape along the first plane is formed into a concave meniscus lens shape and a sectional shape along the second plane which intersects the first plane at right angles is formed into a convex lens shape is used in place of the toroidal lens as the lens which extends into the arc-like shape so as to surround the light source from the front side thereof, the following working effects can be obtained.

Namely, by adopting the configuration in which the sectional shape along the first plane is formed into the concave meniscus lens shape, light from the light source is allowed to emanate from the lens as diffuse light which is diffused more largely than when the toroidal lens is used in the first plane. Additionally, by adopting the configuration in which the sectional shape along the second plane is formed into the convex lens shape, light from the light source is allowed to emanate from the lens as parallel light or diffuse light which is close to parallel light in the second plane. By doing so, a light distribution pattern can be formed which expands into a longer belt-like shape in the direction along the first plane.

As this occurs, in this lens, the cross section along the first plane is formed into the concave meniscus lens shape, and therefore, a depth dimension of the lens can be reduced, thereby making it possible to reduce the thickness of the resulting lamp.

BRIEF DESCRIPTION OF DRAWINGS

FIG. 1 is a sectional plan view of a vehicle lamp according to a first embodiment of the invention.

FIG. 7 is a sectional plan view showing main part of a vehicle lamp according to a second embodiment of the invention.

DETAILED DESCRIPTION

Hereinafter, embodiments of the invention will be described by reference to the drawings.

Firstly, a first embodiment of the invention will be described.

Figure 2:
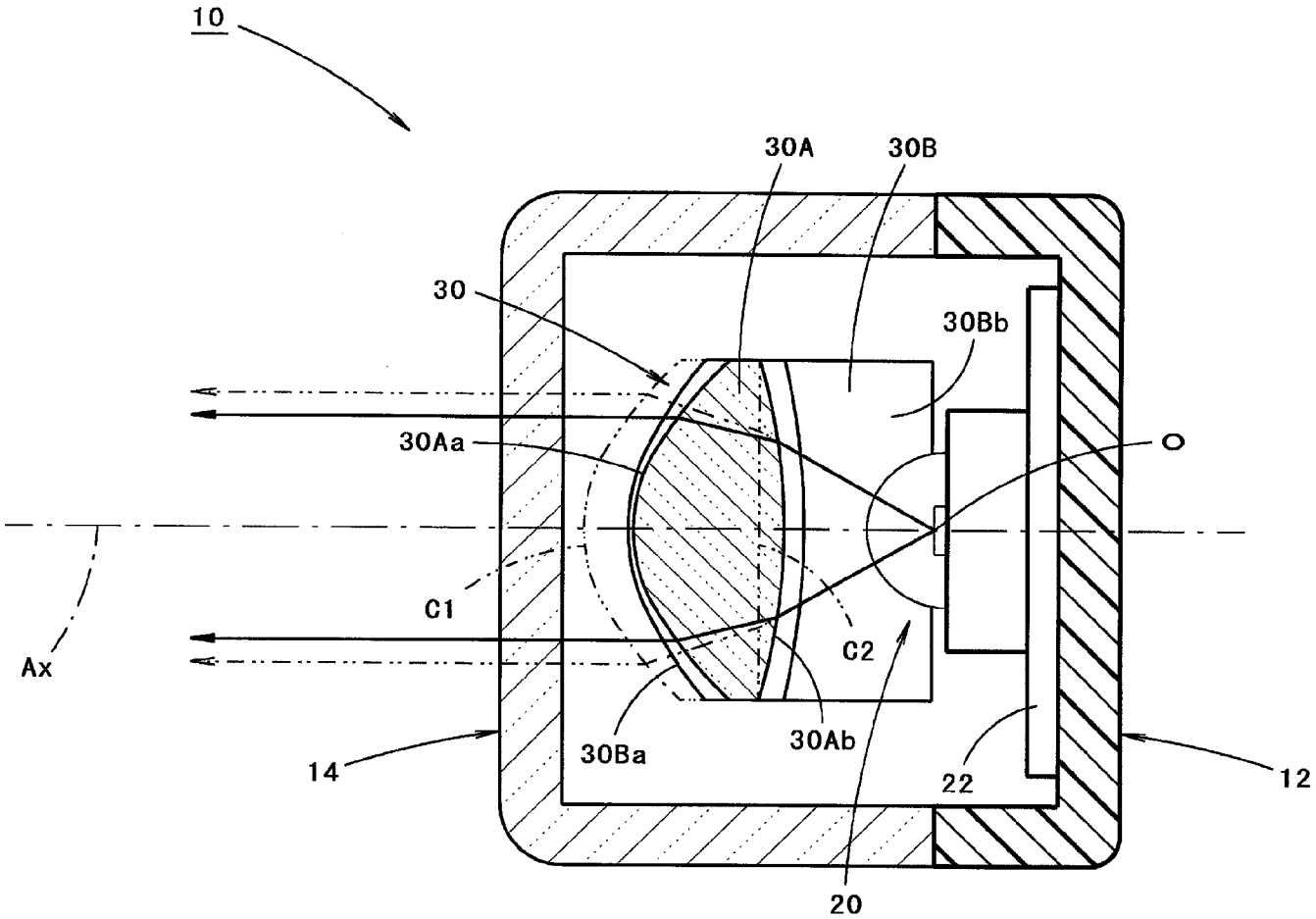
FIG. 2 is a sectional view taken along the line II-II in FIG. 1.

FIG. 1 is a sectional plan view showing a vehicle lamp 10 according to an embodiment of the invention. Additionally, FIG. 2 is a sectional view taken along the line II-II in FIG. 1.

As shown in these figures, the vehicle lamp 10 according to the embodiment is a tail lamp provided at a rear end portion of a vehicle. In this vehicle lamp 10, a light source 20 and a toroidal lens 30 are incorporated in a lamp compartment which is defined by a lamp body 12 and a transparent light transmitting cover 14 which is mounted at a front end opening of the lamp body 12.

It is noted that in this vehicle lamp 10, a direction indicated by an arrow X denotes a front (however at the "rear" of the vehicle) and a direction indicated by an arrow Y denotes a "rightward direction" which is at right angles to the "front" in FIG. 1.

The light source 20 is a red light emitting diode and is disposed with a light emitting surface thereof oriented to the front. This light source 20 is supported on a light source support member 22, and the light source support member 22 is supported, in turn, on the lamp body 12.

The toroidal lens 30 is disposed on an axis Ax which extends in a front-to-rear direction while passing through an illumination center O of the light source 20. As this occurs, the toroidal lens 30 extends into an arc-like shape about a vertical line (a vertical line L shown in FIG. 3) which intersects the axis Ax at right angles at the illumination center O. Both end faces 30*c* of the toroidal lens 30 in the direction in which it extends into the arc-like shape are situated in positions which are turned 90 degrees towards left and right sides from the position of the axis Ax, and the toroidal lens 30 is supported on the light source support member 22 via a pair of left and right lens support members 32 at the pair of left and right end faces 30*c*.

When seen from the top, the light transmitting cover 14 is formed so as to extend to the left and right from the position of the axis Ax while being curved towards the rear. As this occurs, the light transmitting cover 14 is disposed so as to pass by the front of the toroidal lens 30.

Figure 3:
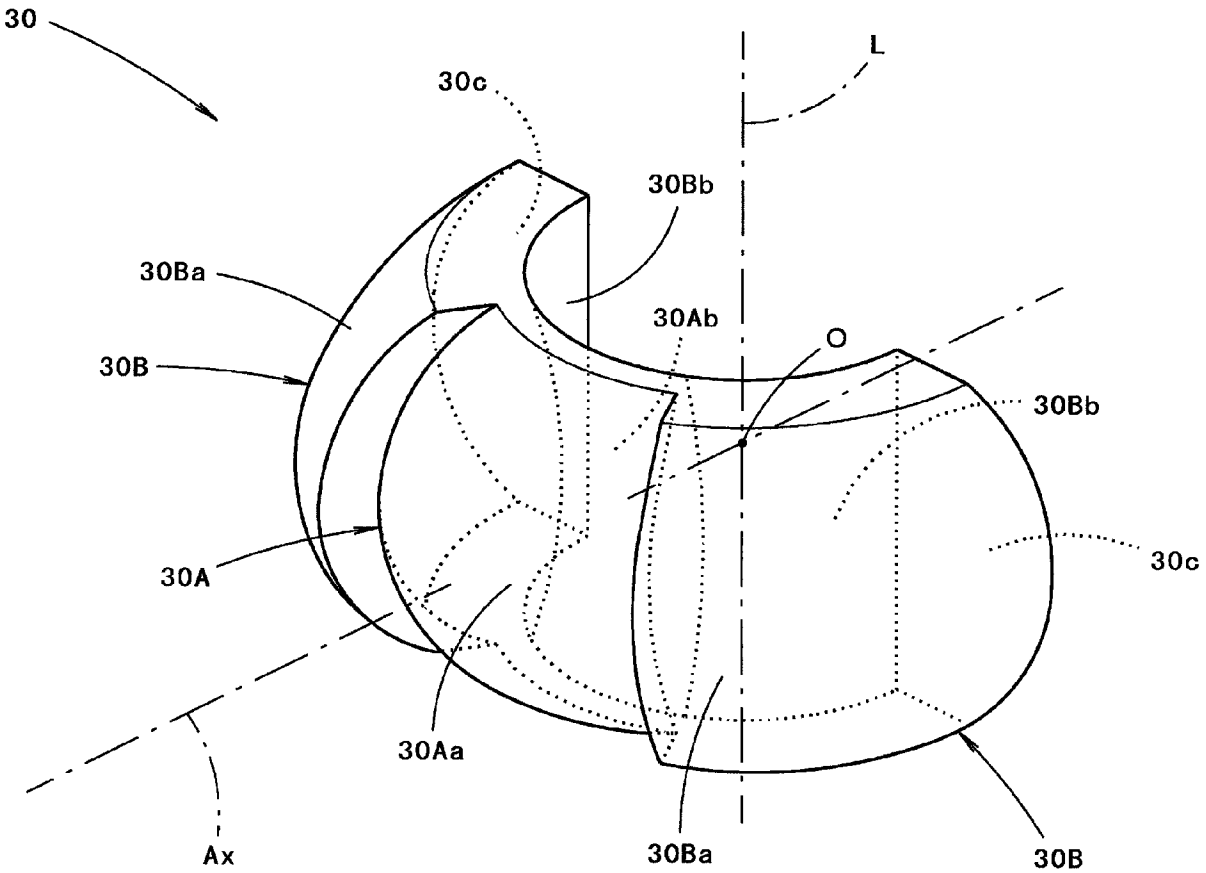
FIG. 3 is a perspective view of a toroidal lens alone for the vehicle lamp.

FIG. 3 is a perspective view of the toroidal lens 30 alone.

As also shown in FIG. 3, the toroidal lens 30 is a transparent product of a synthetic resin such as an acryl resin or the like and is formed of a central portion 30A in the direction in which the toroidal lens 30 extends into the arc-like shape (namely, a central portion in a left-to-right direction) and general portions 30B which are situated at left and right sides of the central portion 30A.

In this case, in the general portions 30B, a front surface 30Ba is formed of a toroidal surface centered at the vertical line L, and a rear surface 30Bb is formed of a cylindrical surface centered at the vertical line L. However, as will be described later, in order to allow light emitted from the light source 20 to emanate therefrom as parallel light directed in a horizontal direction within a vertical plane, a sectional shape of the toroidal surface which forming the front surface 30Ba of the general portion 30B which contains the vertical line L is set not into an accurate arc shape but into a convex curvilinear shape which approximates thereto.

On the other hand, a front surface 30Aa of the central portion 30A is also formed of a toroidal surface centered at the vertical line L. However, the front surface 30Aa is formed so as to be displaced to the rear (accurately speaking, towards the vertical line L) relative to the front surfaces 30Ba of the general portions 30B. As this occurs, the front surface 30Aa of the central portion 30A has a vertical sectional shape resulting from translating the front surfaces 30Ba of the general portions 30B in parallel towards the vertical line L. A sectional shape along a vertical plane containing the vertical line L of a rear surface 30Ab of the central portion 30A is formed into a convex curvilinear shape which protrudes towards the rear (accurately speaking, towards the vertical line L) relative to the rear surface 30Bb of the general portions 30B.

The general portions 30B are configured so that light emitted from the light source 20 is allowed to emanate from the front surface 30Ba as it is as diffuse light in a horizontal plane, while the light is allowed to emanate from the front surface 30Ba as parallel light directed towards the horizontal direction in a vertical plane.

In addition, the central portion 30A is also configured so that light emitted from the light source 20 is allowed to emanate from the front surface 30Aa as it is as diffuse light in a horizontal plane, while the light is allowed to emanate from the front surface 30Aa as parallel light directed in the horizontal direction in a vertical plane.

In FIGS. 1 and 2, curves (including a straight line) C1, C2 which are indicated by chain double-dashed lines represent imaginary extensional planes of the front surfaces 30Ba and rear surfaces 30Bb which would be formed when the general portions 30B are extended in the direction in which the toroidal lens 30 extends into the arc-like shape (that is, a circumferential direction centered at the vertical line L) to the position of the central portion 30A.

Figure 4:
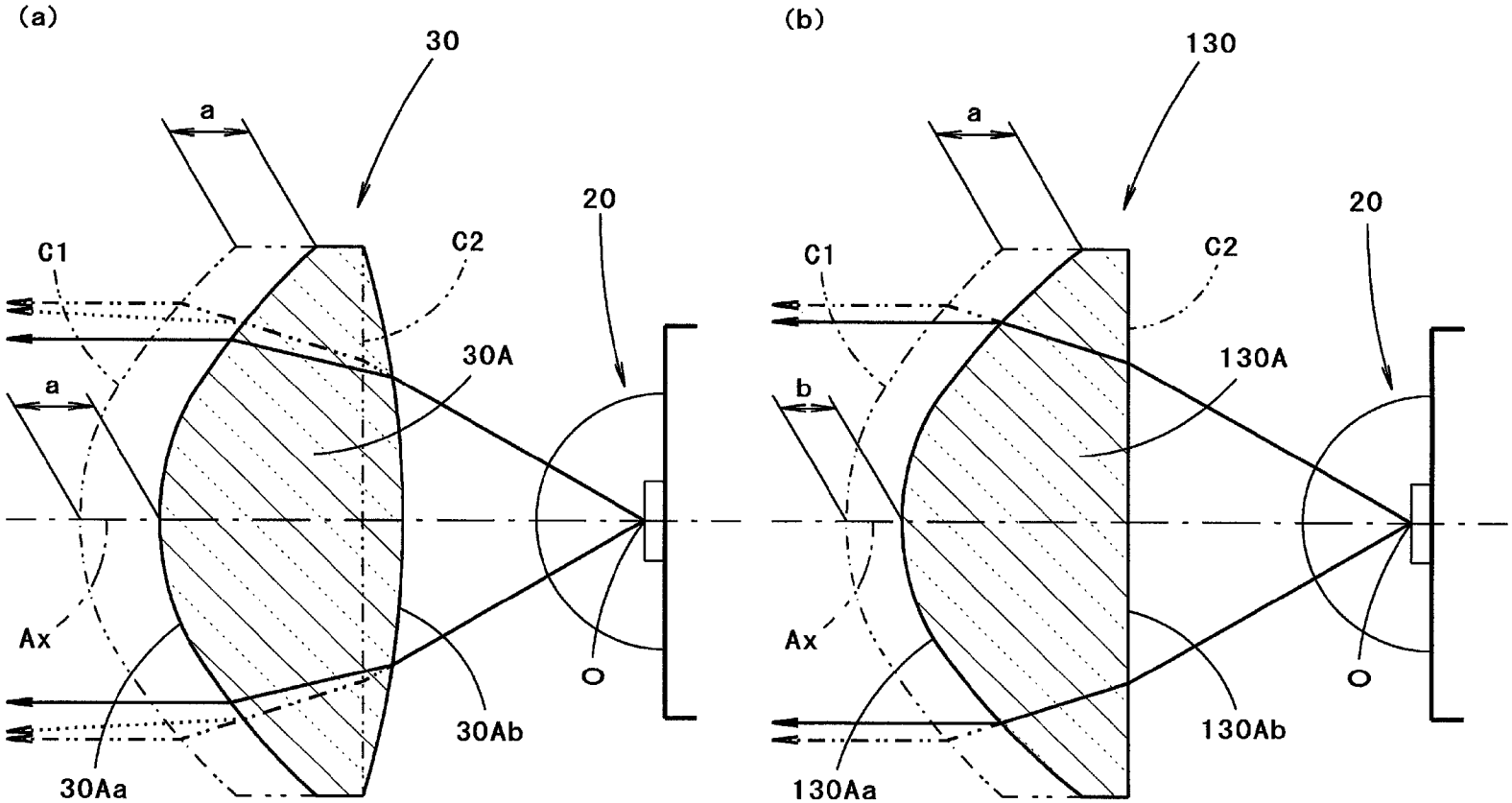
FIG. 4(*a*) shows part of FIG. 2 to explain the function of the embodiment, and FIG. 4(*b*) shows a similar view to FIG. 4(*a*) which shows the configuration and function of a first modified example of the embodiment.

FIG. 4(*a*) shows part of FIG. 2 to explain an optical path within the vertical plane of the central portion 30A.

In FIG. 4(*a*), an optical path indicated by chain double-dashed lines is an optical path which results when a vertical sectional shape of the central portion 30A is the same as a vertical sectional shape of the general portion 30B (that is, the shape outlined by a chain double-dashed line in FIG. 2). In this case, light emanating from the central portion 30A becomes parallel light directed in the horizontal direction.

An optical path indicated by broken lines in FIG. 4(*a*) is an optical path which results when although the front surface 30Aa of the central portion 30A is translated by a dimension "a" to the rear in parallel relative to the imaginary extensional plane C1, the rear surface 30Ab of the central portion 30A remains as indicated by the imaginary extensional plane C2. In this case, light emanating from the central portion 30A becomes light which is slightly diffused vertically.

An optical path indicated by solid lines in FIG. 4(*a*) is an optical path which results when the front surface 30Aa of the central portion 30A is translated by the dimension "a" to the rear in parallel relative to the imaginary extensional plane C1, and a vertical sectional shape of the rear surface 30Ab of the central portion 30A is formed into a convex curvilinear shape which protrudes to the rear relative to the imaginary extensional plane C2 (that is, in the case of the configuration of the embodiment). In this case, light emanating from the central portion 30A becomes parallel light directed in the horizontal direction. In reality, the curvature of a curve forming the vertical sectional shape of the rear surface 30Ab of the central portion 30A is set to such a value as to obtain the parallel light.

Next, the working effects of the embodiment will be described.

The vehicle lamp 10 according to the embodiment includes the toroidal lens 30 which extends into the arc-like shape so as to surround the light source 20 from the front side thereof. Therefore, the light emitted from the light source 20 is allowed to emanate from the toroidal lens 30 as it is as diffuse light in the horizontal plane (that is, in the first plane) in which the toroidal lens extends, while in the vertical plane (that is, the second plane which intersects the first plane at right angles), the light is allowed to emanate from the toroidal lens 30 as parallel light, thereby making it possible to form the light distribution pattern which expands into the belt-like shape in the horizontal direction.

As this occurs, the toroidal lens 30 is formed so that the front surface 30Aa of the central portion 30A thereof in the direction in which the toroidal lens 30 extends into the arc-like shape is displaced rearwards relative to the imaginary extensional plane C1 from the front surfaces 30Ba of the general portions 30B which are situated at the sides of the central portion 30A. Therefore, the depth dimension of the toroidal lens 30 can be reduced while maintaining the optical function thereof. This enables the reduction in thickness of the lamp while the toroidal lens 30 is prevented from interfering with the light transmitting cover 14.

In this way, according to the embodiment, it is possible to reduce the thickness of the vehicle lamp 10 including the toroidal lens 30.

In this embodiment, the vertical sectional shape of the rear surface 30Ab of the central portion 30A of the toroidal lens 30 is formed into the convex curvilinear shape, the following working effects can be obtained.

Namely, in such a setting that light emanating from the general portions 30B becomes parallel light within the vertical plane, only by simply displacing the front surface 30Aa of the central portion 30A rearwards relative to the front surfaces 30Ba of the general portions 30B, light emanating from the central portion 30A becomes light which is slightly diffused in the vertical plane. In contrast with this, as in this embodiment, in the event that the vertical sectional shape of the rear surface 30Ab of the central portion 30A is formed into the convex curvilinear shape, even though the curvature of the front surface 30Aa of the central portion 30A is made small compared with the case where the vertical sectional shape is formed into a linear shape, light emanating from the central portion 30A can be made into parallel light in the vertical plane. Then, the depth dimension of the toroidal lens 30 can be reduced by such an extent that the curvature of the front surface 30Aa of the central portion 30A is reduced.

In this embodiment, there is imposed no specific limitation on the angular range where to form the central portion 30A in the toroidal lens 30. Hence, for example, it can be considered that the central portion 30A is formed within an angular range corresponding to a central angle from 45 to on the order of 90° with respect to the vertical line L.

In the embodiment, while the sectional shapes of the front surfaces 30Ba of the general portions 30B and the front surface 30Aa of the central portion 30A which contain the vertical line L are described as being set to the convex curvilinear shape which approximates to an arc shape, these sectional shapes can, of course, be set to an arc shape.

In the embodiment, while the vehicle lamp 10 is described as being applied to a tail lamp which is provided at the rear end portion of the vehicle, by adopting a similar configuration to that of the embodiment, similar working effects to those described in the embodiment can be obtained wherever in the vehicle the vehicle lamp 10 may be provided or whatever function the vehicle lamp 10 may be caused to perform. For example, in addition to the tail lamp, the vehicle lamp 10 can be applied to a stop lamp, a daytime running lamp, a clearance lamp and the like. As this occurs, in addition to the red light emitting diode, white and amber light emitting diodes can be used depending on to which lamp the vehicle lamp 10 is applied.

Next, modified examples of the first embodiment will be described.

Firstly, a first modified example of the embodiment will be described.

FIG. 4(*b*) is a similar diagram to FIG. 4(*a*) and shows the configuration and function of the first modified example.

As shown in FIG. 4(*b*), although a basic configuration of this modified example is similar to that of the embodiment which has been described above, the configuration of a central portion 130A of a toroidal lens 130 differs from that of the embodiment.

Namely, a curvature of a curve which forms a vertical sectional shape of a front surface 103Aa of the central portion 130A of the toroidal lens 130 is set to take a larger value than a curvature of a curve which forms a vertical sectional shape of an imaginary extensional plane C1 indicated by a chain double-dashed line in FIG. 4(*b*).

Specifically, although the front surface 130Aa of the central portion 130A is displaced to the rear by a dimension "a" relative to the imaginary extensional plane C1 at upper and lower end edges thereof, the front surface 130Aa is displaced to the rear by a dimension "b" (b<a) relative to the imaginary extensional plane C1 in the position of an optical axis Ax. On the other hand, a rear surface 130Ab of the central portion 130A remains as indicated by an imaginary extensional plane C2.

Also when the configuration of this modified example is adopted, as an optical path is indicated by a solid line in FIG. 4(*b*), light from a light source 20 is allowed to emanate from the central portion 130A as parallel light directed in a horizontal direction.

It is particularly effective to adopt the configuration of this modified example in such a case that it is difficult to ensure, between the toroidal lens 30 and the light source, a space to form the vertical sectional shape of the rear surface 30Ab of the central portion 30A into the convex curvilinear shape as in the toroidal lens 30 of the first embodiment.

Next, a second modified example of the first embodiment will be described.

Figure 5:
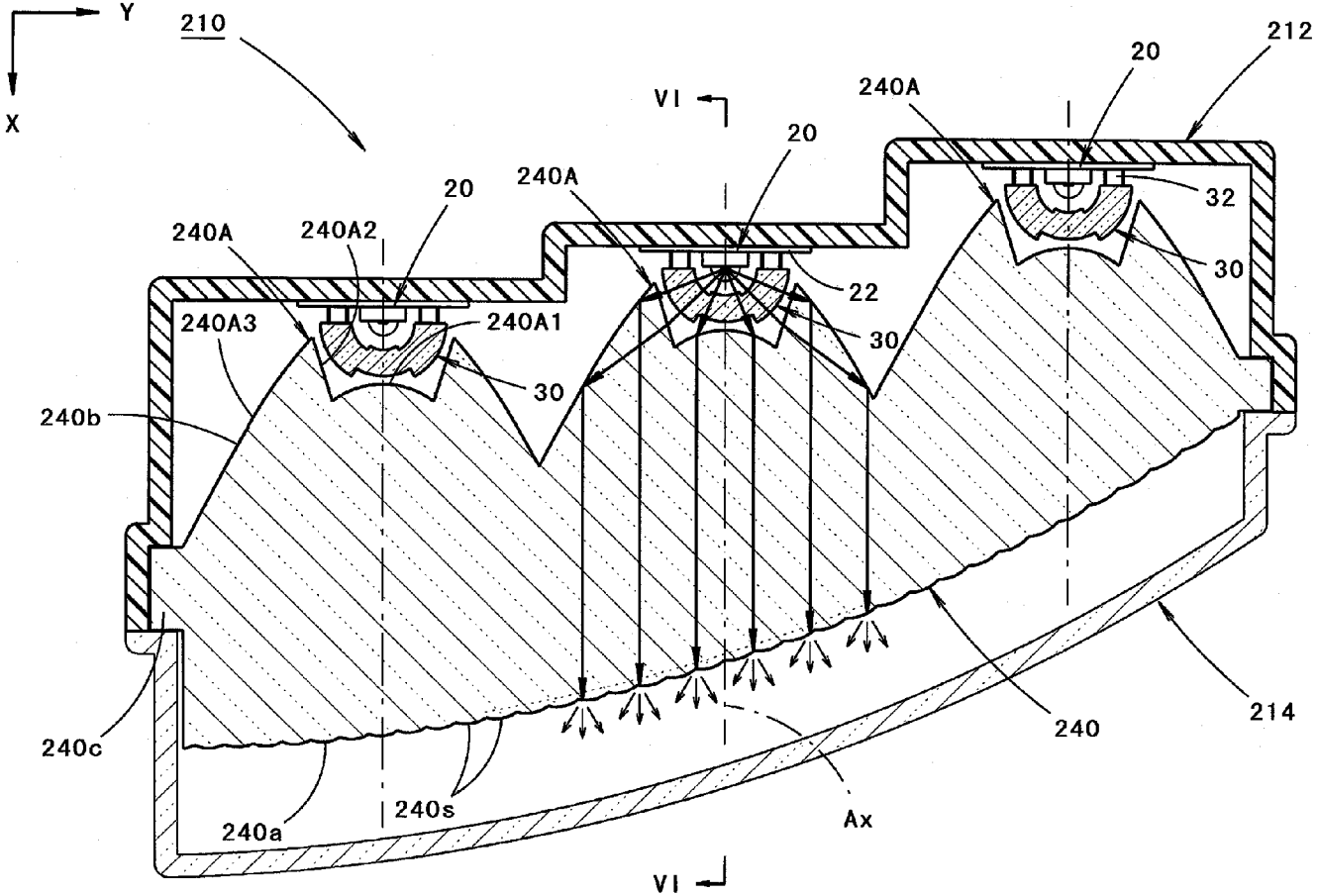
FIG. 5 is a sectional plan view showing a vehicle lamp according to a second modified example of the embodiment.
Figure 6:
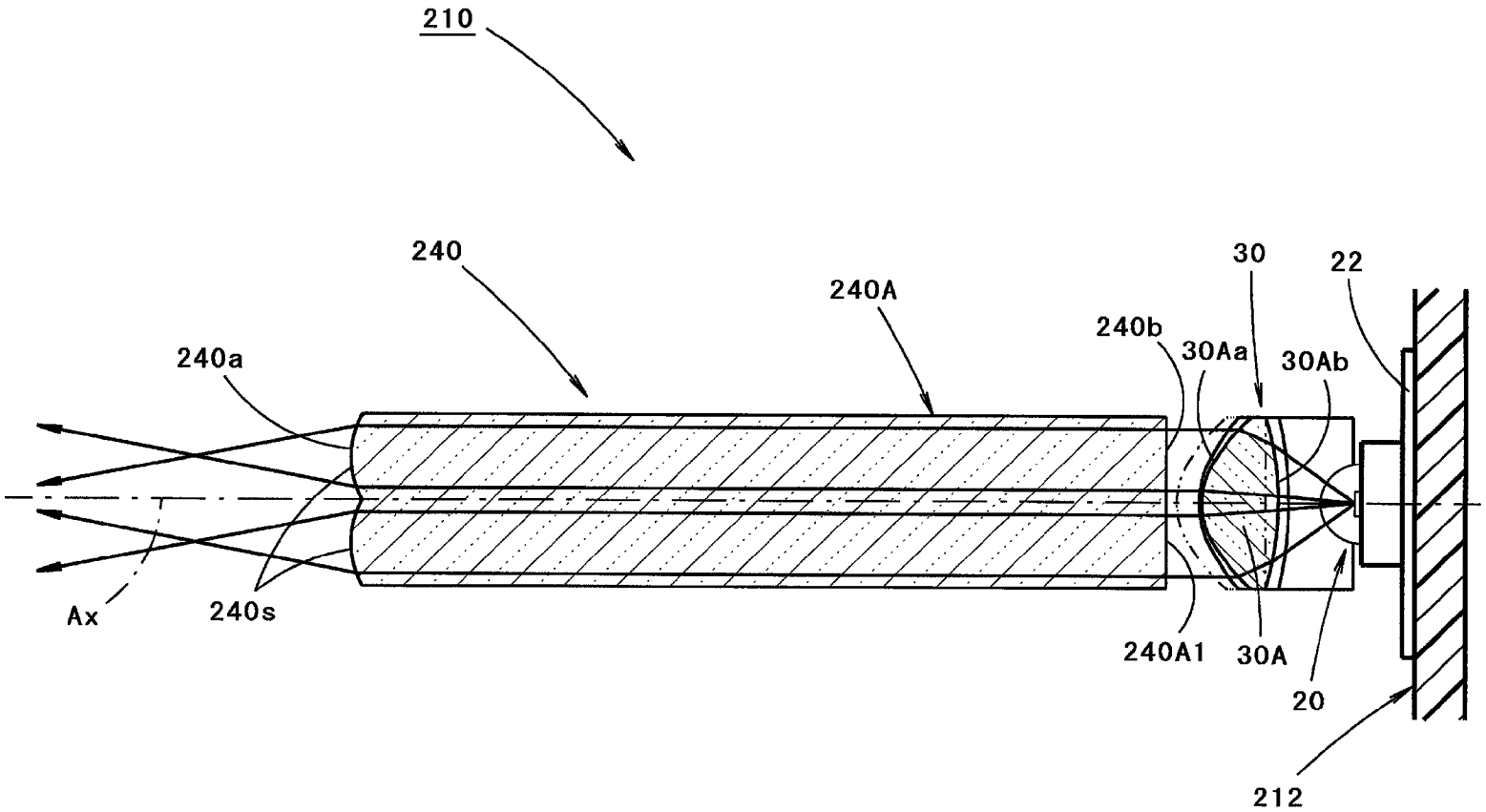
FIG. 6 is a sectional view taken along the line VI-VI in FIG. 5.

FIG. 5 is a sectional plan view of a vehicle lamp 210 according to the second modified example. Additionally, FIG. 6 is a sectional view taken along the line VI-VI in FIG. 5.

As shown in these figures, in this modified example, three light sources 20 and three toroidal lenses 30 like those of the first embodiment are incorporated in a lamp compartment defined by a lamp body 212 and a transparent light transmitting cover 214 mounted at a front end opening in the lamp body 212. Further, in this modified example, a light guiding plate 240 is disposed in front of the three toroidal lenses 30.

The light transmitting cover 214 is formed so as to extend from a left end portion towards a right end portion while turning around to the rear towards the right end portion.

The three light sources 20 and the three toroidal lenses 30 are disposed near the rear of the light guiding plate 240. As this occurs, the three light sources and the three toroidal lenses 30 are disposed at equal intervals in a left-to-right direction on the same horizontal plane in such a way that the light sources 20 and the toroidal lenses 30 are positioned more rearwards as they are placed more rightwards.

The light guiding plate 240 is a transparent product of a synthetic resin such as an acryl resin and is disposed so as to extend along the horizontal plane. Additionally, this light guiding plate 240 allows light emitted from the light sources 20 and emanating from the toroidal lenses 30 to enter from a rear surface 240*b* and to emanate from a front surface 240*a*. A flange portion 240*c* is formed at each of left and right end portions, and the light guiding plate 240 is supported on the lamp body 212 at the two left and right flange portions 240*c*.

The front surface 240*a* of the light guiding plate 240 is formed so as to extend from the left end portion to the right end portion along the light transmitting cover 214 while turning around to the rear towards the right end portion. As this occurs, the front surface 240*a* is configured as a light diffusing plane which diffuses light emanating from the toroidal lenses 30 which enters from the rear surface 240*b* and arrives at the front surface 240*a* vertically and horizontally. Specifically, a plurality of diffusing lens elements 240*s* like fish-eye lenses are formed into two upper and lower layers on the front surface 240*a*.

On the other hand, light control portions 240A designed to control light emitted from the light sources 20 are formed side by side in three locations in the left-to-right direction on the rear surface 240*b* of the light guiding plate 240. As this occurs, these three light control portions 240A are disposed so as to be displaced more rearwards as they are positioned more rightwards.

The three light control portions 240A each have the same configuration.

Namely, these light control portions 240A each include a first incident portion 240A1 where light from the light source 20 is allowed to enter while refracting it forwards, a pair of left and right second incident portions 240A2 which are disposed individually at both sides of the first incident portion 240A1 and where light from the light source 20 is allowed to enter while being refracted sideways, and a pair of left and right reflecting portions 240A3 where light from the light source 20 which enters from these second incident portions 240A2 is reflected internally to the front through total internal reflection.

As this occurs, the first incident portion 240A1 is formed in an area which straddles the axis Ax laterally. The pair of left and right second incident portions 240A2 are formed by vertical surfaces which extend from left and right end edges of the first incident portion 240A1 to the rear in such a way as to expand slightly to the left and right. The pair of left and right reflecting portions 240A3 are formed so as to expand from rear end edges of the second incident portions 240A2 to the front so as to expand to the left and right.

In addition, the first incident portion 240A1 is formed substantially in the same angular range as an angular range where a central portion 30A of the toroidal lens 30 is formed with respect to a vertical line L (refer to FIG. 3). Then, by adopting this configuration, light emanating from the toroidal lens 30 is prevented from entering connecting portions between the first incident portion 240A1 and the second incident portions 240A2 to thereby prevent the production of stray light in advance.

By adopting the configuration of this modified example in which the light guiding plate 240 is provided, a light distribution control on light emitted from the light source 20 can be performed with good accuracy.

As this occurs, the toroidal lens 30 can be disposed close to the first incident portion 240A1 by such an extent that a depth dimension of the toroidal lens 30 is reduced. Therefore, the light source 20 can also be displaced to the front accordingly. Then, this enables more light which emanates from the toroidal lens 30 is allowed to enter the light guiding plate 240, thereby making it possible to enhance the utilization efficiency of light emitted from the light source 20.

Next, a second embodiment of the invention will be described.

Figure 8:
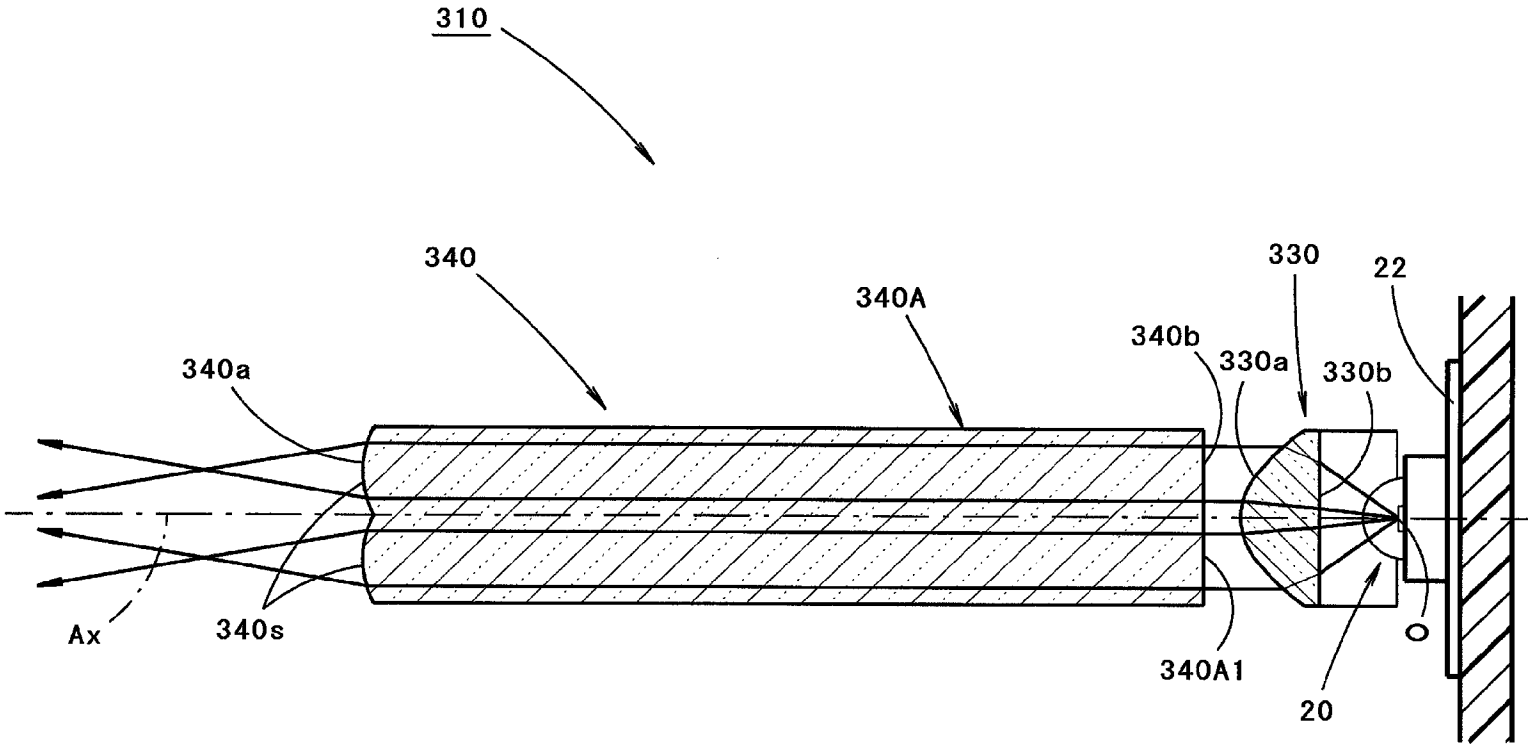
FIG. 8 is a sectional view taken along the line VIII-VIII in FIG. 7.

FIG. 7 is a sectional plan view showing a main part of a vehicle lamp 310 according to this embodiment. Additionally, FIG. 8 is a sectional view taken along the line VIII-VIII in FIG. 7.

As shown in these figures, although a basic configuration of this embodiment is similar to that of the second modified example of the first embodiment, the second embodiment differs from the second modified example in that a lens 330 is disposed in place of the toroidal lens 30. Additionally, the configuration of a rear surface 340*b* of a light guiding plate 340 differs slightly from that of the second modified example.

Namely, the lens 330 of this embodiment is disposed so as to extend into an arc shape about a vertical line which passes through an illumination center O of a light source 20 and is supported on a light source support member 22 at a pair of left and right end faces 330*c* via a pair of left and right lens support members 32.

The lens 330 is a transparent product of a synthetic resin such as an acryl resin. A sectional shape of the lens 330 along a horizontal plane which contains the illumination center O is formed into a concave meniscus lens shape, while a sectional shape along a vertical plane which contains the illumination center O is formed into a planoconvex lens shape. As this occurs, a rear surface 330*b* of the lens 330 is formed by a cylindrical surface centered at the vertical line as done in the second modified example. However, a front surface 330*a* of the lens 330 is formed by a free curved surface which results when a toroidal surface centered at the vertical line is slightly deformed.

Specifically, a horizontal sectional shape of the front surface 330*a* of the lens 330 which passes through the illumination center O of the light source 20 is set to an arc shape which results when an arc shape concentric with an arc shape which forms a horizontal sectional shape of the rear surface 330*b* is translated to the rear in parallel. As a result, a radial thickness at a horizontal section of the lens 330 is made to take larger values in thickness as the lens 330 is deployed from the axis Ax more largely in a lateral direction. As a result of this configuration, the lens 330 allows light from the light source 20 to enter as it is from the rear surface 330*b* without being refracted in a horizontal plane and to emanate from the front surface 330*a* while refracting it so as to spread to left and right sides of the lens 330 from the axis Ax on the front surface 330*a*.

A vertical sectional shape of the front surface 330*a* of the lens 330 is set to a convex curvilinear shape. As this occurs, in order to allow light from the light source 20 to emanate from the lens 330 as parallel light which is directed in a horizontal direction within a vertical plane, the curvature of the convex curvilinear shape is set to take slightly different values depending on angular positions where the lens 330 is deployed laterally from the axis Ax.

On the other hand, similar to the light guiding plate 240 of the second modified example, the light guiding plate 340 of this embodiment also includes light control portions 340A provided on the rear surface 330*b* thereof which each include a first incident portion 340A1, a pair of left and right second incident portions 340A2 and a pair of left and right reflecting portions 340A3.

As this occurs, a vertical sectional shape of the light control portion 340A is similar to that of the light control portion 240A of the second modified example, but a horizontal sectional shape differs partially.

Namely, the horizontal sectional shape of the first incident portion 340A1 is similar to that of the first incident portion 240A1 of the second modified example, whereby light from the light source 20 is allowed to enter the light guiding plate 340 while being refracted to the front. However, since light emitted from the light source 20 arrives at the first incident portion 340A1 while being deflected laterally by the lens 330, light entering the light guiding plate 340 from this first incident portion 340A1 arrives at the front surface 340*a* of the light guiding plate 340 as light diffused laterally.

On the other hand, the second incident portions 340A2 and the reflecting portions 340A3 are configured so that light from the light source 20 which enters the light guiding plate 340 from the second incident portions 340A2 is reflected internally so as to allow the light to arrive at the front surface 340*a* as parallel light. As this occurs, since light from the light source 20 arrives at the second incident portions 340A2 while being deflected laterally by the lens 330, in this embodiment, left and right inclination angles of the second incident portions 340A2 and the curvature of a curve forming the horizontal sectional shapes of the reflecting portions 340A3 are set to values which are slightly different from those of the second modified example.

Also in this light guiding plate 340 of this embodiment, a plurality diffusing lens elements 340*s* like fish-eye lenses are formed into two upper and lower layers on the front surface 340*a*.

When the configuration of this embodiment is adopted, light from the light source 20 is allowed to emanate from the lens 330 as diffuse light which is diffused more largely than the diffuse light emanating from the toroidal lens 30 of the second modified example in the horizontal plane. Additionally, light emitted from the light source 20 is allowed to emanate from the lens 330 as parallel light in the vertical plane. This enables the formation of a light distribution pattern which expands into a longer belt-like shape in the lateral direction.

Moreover, since the lens 330 of this embodiment includes the light guiding plate 340, the light distribution control on light emitted from the light source 20 can be performed with good accuracy.

Also in this embodiment, since the vehicle lamp 310 includes the light guiding plate 340, the light distribution control on light emitted from the light source 20 can be performed with good accuracy.

As this occurs, the lens 330 can be disposed close to the first incident portion 340A1 by such an extend that a depth dimension of the lens 330 can be reduced, and therefore, the light source 20 can also be displaced to the front accordingly. By doing so, more light which emanates from the lens 330 is allowed to enter the light guiding plate 340, thereby making it possible to enhance the utilization efficiency of light emitted from the light source 20.

Incidentally, as in the vehicle lamp 310 according to this embodiment, when the light source 20 is formed of a light emitting diode and is disposed with a light emitting surface thereof oriented to the front, when the vehicle lamp 310 is observed from the front, there is a tendency that light in an area near the axis Ax on the front surface 340*a* of the light guiding plate 340 becomes too bright locally.

In this respect, in this embodiment, light from the light source 20 arrives at the first incident portion 340A1 while being deflected laterally by the lens 330 and the light which enters the light guiding plate 340 from the first incident portion 340A1 arrives at the front surface 340*a* as light which is diffused laterally. Therefore, when the vehicle lamp 310 is observed from the front, it is possible to prevent light in an area near the axis Ax on the front surface 340*a* of the light guiding plate 340 from becoming too bright locally.

In the second embodiment, while the vertical sectional shape of the lens 330 is described as being formed into the planoconvex lens shape, the vertical sectional shape can be formed into a double-convex lens shape or a convex meniscus lens shape.

It is noted that the numerical values shown as specifications in the embodiments and the modified examples are only examples, and hence, these numerical values may, of course, be set to different values as required.

In addition, the invention is not limited to the embodiments and the modified examples, and hence, other configurations including various modifications added can be adopted.

What is claimed is:

1. A vehicle lamp comprising:

a light source; and a toroidal lens which extends into an arc shape along a horizontal plane which extends along an optical axis of the light source so as to surround the light source from a front side thereof, the toroidal lens comprising:

a rear surface through which light from the light source enters the toroidal lens; and a front surface through which the light from the light source exits the toroidal lens, wherein in a vertical plan view on the horizontal plane, the front surface of the toroidal lens comprises:

a recess provided at a center portion of the toroidal lens and recessed toward the light source; and surrounding portions provided at lateral ends of the toroidal lens, each of surrounding portions provided at each end of the recess;

wherein a radius of curvature of a front surface of the recess along the horizontal plane is equal to a radius of curvature of each surrounding portion along the horizontal plane.

2. The vehicle lamp according to claim 1, wherein a curvature of a curve forming a sectional shape along a second plane which intersects the first plane at right angles on the front surface of the central portion is set to a larger value than that of a curvature of a curve forming a sectional shape along the second plane on the front surface of an end portion of the end portions.

3. The vehicle lamp according to claim 1, wherein a sectional shape along the second plane on a rear surface of the central portion is formed into a convex curvilinear shape.

4. The vehicle lamp according to claim 1, wherein a light guiding plate configured to allow light from the light source which emanates from the toroidal lens to enter from a rear surface and to emanate from a front surface of the light guiding plate is disposed on a front side of the toroidal lens so as to extend along the first plane, and wherein the rear surface of the light guiding plate comprises:

a first incident portion configured to allow the light emanating from the toroidal lens to enter while refracting the emanating light forwards, second incident portions which are situated at opposite sides of the first incident portion and configured to allow light entering from the second incident portions to enter while being refracted to sideways, and a reflecting portion configured to reflect the light emanating from the toroidal lens which enters from the second incident portions to the front through internal reflection.

5. A vehicle lamp comprising:

a light source; and a lens extending into an arc shape along a first plane so as to surround the light source from a front side of the light source, wherein a sectional shape of the lens along the first plane is formed into a concave meniscus lens, and wherein a sectional shape of the lens along a second plane which intersects the first plane at right angles is formed into a double-convex lens, wherein a radial thickness of the concave meniscus lens along the first plane increases from a center portion of the lens towards lateral end portions of the lens, the lens configured to receive light from the light source to enter the lens without being refracted in the first plane, wherein the lens comprises:

a front surface through which light from the light source exits the lens; and a rear surface through which the light from the light source enters the lens, and wherein the rear surface is formed as a cylindrical surface on the first plane and the front surface is formed in an arc shape concentric with the rear surface on the first plane.

6. The vehicle lamp according to claim 1, wherein the toroidal lens extends into the arc shape about a vertical center line provided on the light source, the vertical centerline extending perpendicular to the horizontal plane.

7. The vehicle lamp according to claim 1, wherein in the vertical plan view on the horizontal plane, the rear surface comprises a protrusion provided at the center portion of the toroidal lens and protruding from the rear surface toward the light source.

8. The vehicle lamp according to claim 1, wherein the toroidal lens is configured to diffuse light from the light source along the horizontal plane.

9. The vehicle lamp according to claim 5, wherein the toroidal lens is configured to diffuse light from the light source along the first plane.

* * * * *